US005363590A

United States Patent [19]

Lee

[11] Patent Number: 5,363,590

[45] Date of Patent: Nov. 15, 1994

[54] SAFETY APPARATUS FOR CANDLES

[76] Inventor: Seung S. Lee, 808 Pony Trail, Franklin Lakes, N.J. 07417

[21] Appl. No.: 37,302

[22] Filed: Mar. 26, 1993

[51] Int. Cl.[5] ..... F23D 3/16

[52] U.S. Cl. ..... 431/253; 431/289

[58] Field of Search ..... 431/289, 292, 293, 297, 431/253; 362/161, 162, 163

[56] References Cited

U.S. PATENT DOCUMENTS

| | | | |
|---|---|---|---|
| 2,750,775 | 6/1956 | Robertson et al. | 431/289 |
| 2,888,816 | 6/1959 | Kanost | 431/297 |
| 3,071,952 | 1/1963 | Churchill | 431/293 |
| 4,186,430 | 1/1980 | Britton | 362/161 |
| 4,477,249 | 10/1984 | Ruzek et al. . | |
| 4,568,269 | 2/1986 | Lin . | |
| 4,721,455 | 1/1988 | Barfus . | |
| 4,759,699 | 7/1988 | Rubarth . | |
| 4,804,323 | 2/1989 | Kim . | |
| 5,015,175 | 5/1991 | Lee . | |
| 5,129,159 | 7/1992 | Fuenalida . | |

FOREIGN PATENT DOCUMENTS

| | | | |
|---|---|---|---|
| 59046 | 2/1891 | Germany | 431/292 |
| 332901 | 2/1920 | Germany | 431/293 |
| 813686 | 7/1951 | Germany | 431/293 |
| 18491 | of 1889 | United Kingdom | 431/289 |

*Primary Examiner*—Carroll B. Dority
*Attorney, Agent, or Firm*—Michael Lee

[57] ABSTRACT

This invention relates to a safety apparatus for candles and candle holders which comprises a non-flammable fitting means that completely encloses a longitudinal portion of a candle.

5 Claims, 2 Drawing Sheets

SAFETY APPARATUS FOR CANDLES

BACKGROUND OF THE INVENTION

1. Field of the Invention

The present invention relates to a safety apparatus for candles that extinguishes the candle flame when the flame reaches a predetermined position, particularly, at the base of a candle.

BACKGROUND OF THE INVENTION

Candles are generally constituted by bodies of wax, i.e., paraffin, tallow or other flammable substances in which a wick is embedded. For illustration purposes of the present invention, the term "wax" refers to any flammable substance conventionally used to constitute a candle body. Although the use of candles as lighting devices has largely been replaced by other modern electrical lighting devices, candles are still widely used for decorative purposes and to create festive moods, for example, on birthday cakes, in flower-arrangements and the like.

However, the flame of candles can create fire hazards, especially when lighted candles are accidentally unattended for a period of time. If unattended, the flame of a candle may ignite fire on flammable materials in its surrounding, especially at its base.

There are many commercial novelty products in the market that are designed to be used with candles. Such products include candle holders, cake dividers, and candles that produce a melody when lighted (melodic candle). For example, a birthday candle holder is disclosed in U.S. Pat. No. 4,721,455, and a cake divider is disclosed in U.S. Pat No. 5,129,159. U.S. Pat. Nos. 4,477,249; 4,568,269; 4,804,323; and 5,015,175 disclose melodic candle assemblies. Most of these novelty products are designed to be disposable and, thus, are fabricated from disposable materials, particularly plastics. Although there are fire-resistant plastics and additives to make ordinary plastics fire-resistant, they are either highly costly or not suitable for use in food contacting applications. Consequently, these novelty products pose fire safety problems in that the flame of a candle used in conjunction with the products can spread to the products themselves. Such a spread of fire can be especially hazardous in melodic candle assemblies since the assemblies contain sealed parts and batteries that may explode upon exposure to flame.

As such, it would be desirable to provide a safety apparatus that extinguishes the flame of a candle when it reaches a predetermined position on the candle.

SUMMARY OF THE INVENTION

There is provided in accordance with the present invention, a safety apparatus for candles comprising a non-flammable fitting means, which has an upper opening and a lower opening, that completely encloses a longitudinal portion of a candle.

There is further provided a safety apparatus for a candle holder, which has a thin-walled, upwardly extended candle holding section, comprising a non-flammable fitting means, which has an upper opening and a lower opening, that completely encloses a portion of the upwardly extended candle holding section of the holder. The upper opening of the fitting means may further be bent toward the center of the candle holder to substantially cover the outwardly exposed surface area created by the wall thickness of the upwardly extended candle holding section.

The safety apparatus of the present invention extinguishes the flame of a candle when the flame reaches a predetermined position on the candle.

BRIEF DESCRIPTION OF THE DRAWINGS

The inventions will be more fully understood from the following description of the accompanying drawings.

DETAILED DESCRIPTION OF THE INVENTION

Figure 1:
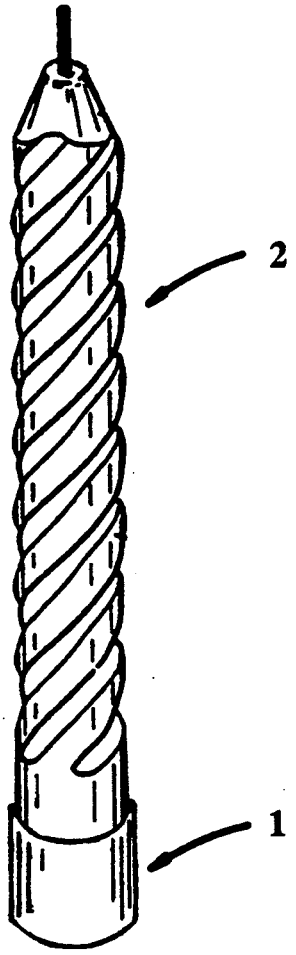
FIG. 1 shows a candle fitted with one of the safety apparatus of the present invention.
Figure 2:
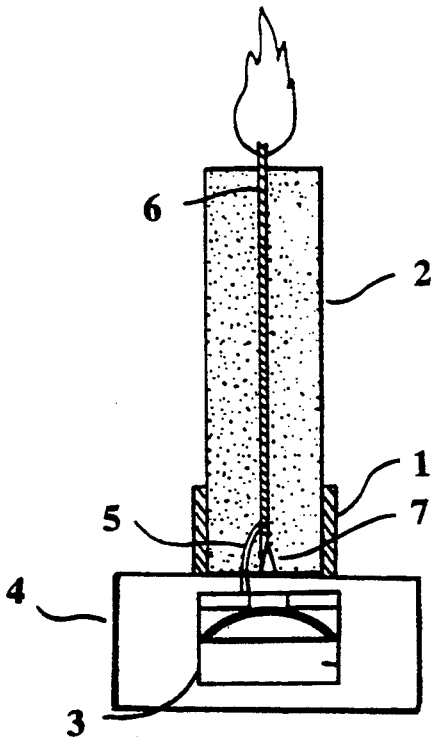
FIG. 2 shows a melodic candle assembly protected with one of the present safety apparatus.

The present invention is more easily understood by directing to the figures. Although any shape of candles can be protected with the safety apparatus of the present invention, for purposes of illustration, only cylindrical candles are discussed. One embodiment of the present invention, as shown in FIGS. 1 and 2, is a safety apparatus 1 which comprises a fitting means that encloses a longitudinal section, preferably at the base, of a candle. The safety apparatus prevents the flame of a candle from reaching a predetermined position of the candle by extinguishing the flame when the flame reaches the safety apparatus.

FIG. 1 illustrates a candle 2 fitted with the present safety apparatus 1. FIG. 2 illustrates a melodic candle which consist of a candle 2, an integrated circuit sound emitting device 3, a housing 4 that encloses the sound emitting device, and a flame-sensing device 5 that is located next to the wick 6 of the candle. The candle 2 is affixed to the housing 4 by a securing means 7. As mentioned above, the housing in general is fabricated from a plastic, such as polyethylene, since plastic parts are easier to produce and more economical than other protective materials such as metals. Consequently, without the safety apparatus of the present invention, if a lighted candle is unattended, there is a potential hazard that the housing 4 may catch fire and/or the sound emitting device may be overheated to cause an explosion. The safety apparatus ensures that the flame of the candle will be extinguished before it reaches the housing.

Figure 3:
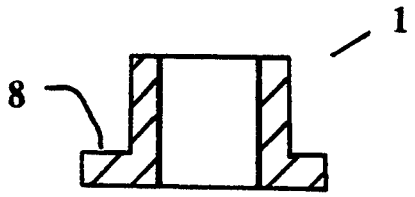
FIG. 3 shows one of the present safety apparatus that has an added stabilizing means.

As another embodiment of the present invention, the safety apparatus may further comprise an radially extending means 8 (of FIG. 3) projecting from the base of the fitting means, for example shown in FIG. 3, to provide an additional stability to the candle that is fitted with the safety apparatus. The radially extending means can be of any shape that adds stability to the safety apparatus, e.g., disc, equally spaced projections, and the like.

Figure 4:
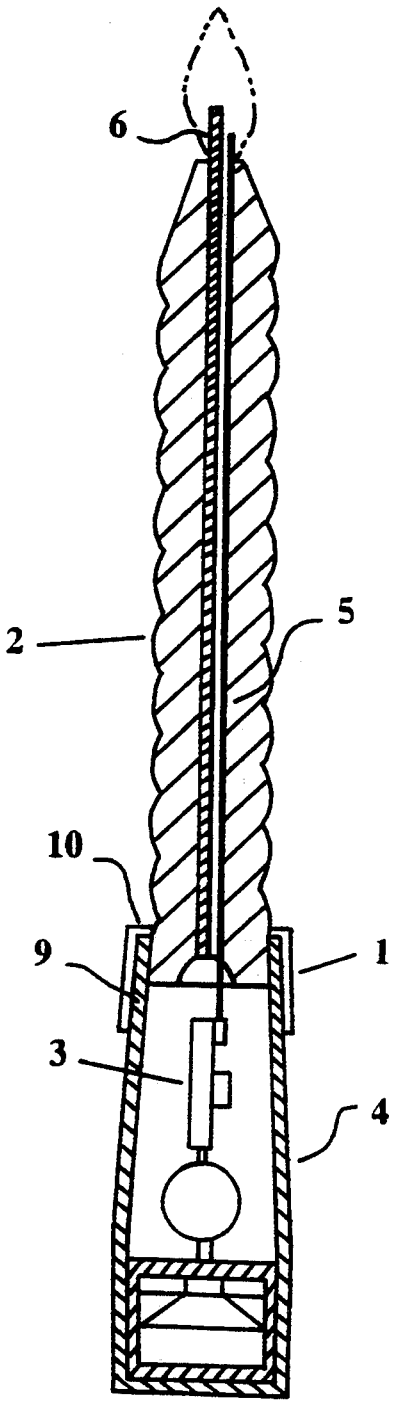
FIG. 4 shows another melodic candle assembly protected with one of the present safety apparatus which has an added feature that covers the surface area created by the wall thickness of the candle holding section.
Figure 5:
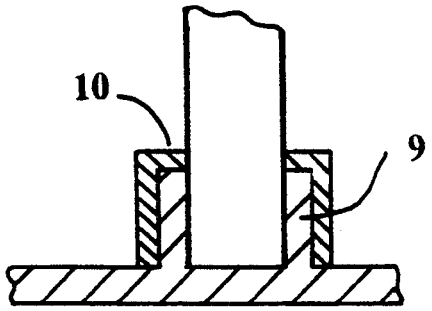
FIG. 5 shows in more detail the additional feature illustrated in FIG. 4

FIGS. 4 and 5 illustrate yet another embodiment of the present invention. If a candle is placed in a disposable candle holder or a melodic candle assembly which is equipped with a candle holder, the present safety apparatus 1 fits over the upwardly extended candle holding section 9 of the candle holder that holds the base of a candle. The safety apparatus, in this case, has a shape that conforms to the outside contour of the candle holding section. Preferably, the size of the safety apparatus is such that it fits tightly over the upwardly extended candle holding section to be semi-permanently affixed thereto without the use of any adhesive. In addition, as a preferred embodiment of the present invention, the upper end (opening) of the safety apparatus be bent 10 toward the center sufficiently enough to cover the surface area created by the wall thickness of the candle holding section, thereby covering the top portion or all of the outwardly exposed surface of the candle holding section. It has been found that covering the top portion of the candle holding section provides an improved flame-extinguishing function.

The safety apparatus of the present invention can be fabricated from any non-flammable materials. The suitable materials include metals, such as aluminum, steel, iron, brass, copper and alloys thereof; ceramics; glasses; high-temperature plastics, such as aromatic polyesters, e.g., polycyclohexylenedimethylene terephthalate; plastics, such as polyethylene, polypropylene and polyethylene terephthalate, compositions containing tin heat-stabilizers; metal foil laminated flame-retarded papers; flame-retarded papers; and the like. Of these, preferred are metals for their fabricability and heatstability, and more preferred are aluminum and its alloys.

The suitable materials can be fabricated into one unit apparatus that fits over a candle or a candle holder. As an alternative embodiment, if a metal or foil laminate is employed, a sheet or strip of that material can be tightly wrapped over a candle or a candle holder and then sealed by any known means, such as folded unto itself or affixed with a high-temperature adhesive.

The thickness of the safety apparatus may be varied. The only requirement is that the safety apparatus has a minimal rigidity to support the weight of molten wax and the exposed portion of the candle wick.

Although the dimensions of the safety apparatus may be varied to accommodate different needs of different shapes and uses of candles, it is preferred that the ratio between the length and the average diameter of the safety apparatus is equal to or greater than about 0.5. More preferably, the length to diameter ratio is equal to or greater than about 0.75, and more preferably, equal to or greater than about 1. As the length to diameter ratio increases, the convective air movement around the flame of a candle that may supply fresh air to the burning flame that reached the safety apparatus increases, thereby decreasing the efficiency of the safety apparatus. Additionally, although the safety apparatus of the present invention can be utilized for any size of candles, the apparatus works more efficiently for candles having an average diameter of equal to or less than about 1 inch, more preferably equal to or less than about $\frac{1}{2}$ inches, and most preferably equal to or less than about $\frac{3}{8}$ inches.

It should be noted that, in addition to the flame-extinguishing function, the safety apparatus can be painted, tinted or engraved to add decorative and/or informational features to the candles.

What is claimed is:

1. A safety apparatus for a plastic housing containing a candle flame activatable electronic melodic assembly, comprising a non-flammable fitting means, said plastic housing comprising a candle holder, said candle holder having an upwardly extended candle holding section which has an outside surface and an inside surface, said fitting means having an inside shape that conforms to said outside surface of said candle holding section so as to tightly fit over said candle holding section, wherein said candle holding section has an average diameter equal to or less than about $\frac{1}{2}$ of an inch and said fitting means has a length to average diameter ratio of equal to or greater than about 0.75.

2. The safety apparats of claim 1, wherein said upwardly extended candle holding section has an average diameter equal to or less than about $\frac{3}{8}$ of an inch.

3. The safety apparatus of claim 1, wherein said fitting means has a length to average diameter ratio of equal to or greater than about 1.

4. The safety apparatus of claim 1, wherein said non-flammable fitting means is fabricated from a non-flammable material selected from the group consisting of metals, ceramics, glass, high-temperature plastics, heat-stabilized plastic compositions, flame-retarded papers and metal foil laminated flame-retarded papers.

5. The safety apparatus of claim 1, wherein said non-flammable fitting means is fabricated from aluminum.

* * * * *